US005842663A

United States Patent [19]

O'Connor et al.

[11] Patent Number: 5,842,663

[45] Date of Patent: Dec. 1, 1998

[54] WINDING OF TAPE INTO PADS

[75] Inventors: Lawrence J. O'Connor; Darrell Van Mol, both of Winnipeg, Canada

[73] Assignee: KT Industries Inc., Fort Wayne, Ind.

[21] Appl. No.: 795,570

[22] Filed: Feb. 6, 1997

[51] Int. Cl.[6] ..... B65H 18/26

[52] U.S. Cl. ..... 242/530.4; 242/530.1

[58] Field of Search ..... 242/530.3, 530.4, 242/530.1

[56] References Cited

U.S. PATENT DOCUMENTS

| | | | |
|---|---|---|---|
| 868,761 | 10/1907 | Cohen | 242/530.4 |
| 1,637,424 | 8/1927 | Morow . | |
| 2,984,427 | 5/1961 | Rockstrom | 242/530.4 |
| 2,985,398 | 5/1961 | Rockstrom et al. | 242/530.4 |
| 3,247,812 | 4/1966 | Luciano et al. . | |
| 3,750,973 | 8/1973 | Walters | 242/530.4 |
| 3,949,948 | 4/1976 | Tomma | 242/530.4 |
| 3,998,399 | 12/1976 | Held et al. | 242/530.4 |
| 4,117,788 | 10/1978 | Whitehead . | |
| 4,137,614 | 2/1979 | Wolstencroft | 242/530.1 |
| 4,209,138 | 6/1980 | Cecchi | 242/530.3 |
| 4,218,029 | 8/1980 | Schwenzfeier et al. | 242/530.3 |
| 4,220,291 | 9/1980 | Papa | 242/530.3 |
| 4,293,101 | 10/1981 | Dunaevsky et al. | 242/530.4 |
| 4,438,888 | 3/1984 | Seelinger | 242/530.3 |
| 4,447,016 | 5/1984 | Enberg et al. | 242/530.4 |
| 5,161,747 | 11/1992 | Kramer | 242/530.4 |

FOREIGN PATENT DOCUMENTS

| | | | |
|---|---|---|---|
| 0 465 289 A1 | 1/1992 | European Pat. Off. | 242/530.4 |
| 1 143 074 | 1/1963 | Germany | 242/530.3 |
| 1 175 959 | 6/1964 | Germany | 242/530.3 |
| 60-130417 | 7/1985 | Japan | 242/530.3 |
| 745831 | 7/1980 | U.S.S.R. | 242/530.1 |
| 625798 A | 1/1988 | U.S.S.R. | 242/530.1 |
| 2 274 835 | 8/1994 | United Kingdom | 242/530.4 |

*Primary Examiner*—John P. Darling

*Attorney, Agent, or Firm*—Adrian D. Battison; Murray E. Thrift

[57] ABSTRACT

The winding of tape into pads is effected on a machine which controls the tension in the tape as it is laid onto the pad by a lay-on roller which also drives the rotation of the pad. A pad is a spiral winding of tape in which each turn of tape is laid directly on top of the previous turns. The machine includes a series of cores one for each tape mounted on a shaft for independent rotation of each core relative to the shaft. The tape is directed from common guide rollers to a series of individual arms one for each tape with each arm being mounted on a shaft for individual adjustment along the length of the shaft to a position associated with the particular core. The shaft drives a lay-on roller at an outer end of the arm and the arm can pivot about the shaft to accommodate changes in diameter of the package as built. The use of lay-on rollers which are all driven at the same speed ensures a constant tension in the tapes even if the tapes are deviated outwardly so as to increase the spacing between the tapes relative to the original web from which the tapes are slit.

25 Claims, 6 Drawing Sheets

WINDING OF TAPE INTO PADS

BACKGROUND OF THE INVENTION

This invention relates to a method and apparatus for winding of tape into a plurality of pads.

Tape is generally formed by slitting from a wider web of the material from which the tape is formed.

Tapes are then commonly wound either into pads or into packages. A pad is a wound structure of tape in which each turn of tape is laid directly onto the previous turns in spiral manner so that the finished structure of the pad forms a flat disc with the width of the disc equal to the width of the tape and the diameter of the pad equal to a required diameter, which is often the maximum which can be achieved while the pad remains stable without danger of collapse.

Other packages of tape are generally formed by traversing the package axially while the package rotates so as to form helical turns of the tape. Thus the width of the package is many times greater than the width of the tape. Such packages can store longer lengths of the tape. However some end uses cannot accommodate the width of the package and thus require the manufacture and use of a pad of the tape.

Tape in the industries concerned is generally considered to be a material having a width less than about 6 inches. The winding of tape into pads of tape of sufficiently large diameter in order to supply a significant length of the tape provides a structure which is inherently unstable in view of the narrow width of the tape and the pad. This instability of course increases as the width of the tape decreases so that tapes of a width less than 2 inches raise significant winding difficulties. In some cases tapes of a width down to 0.25 inches must be wound in this manner. However pads are still required for various end uses despite the inefficiency of this storage system and the inherent instability of the resultant package.

The conventional technique for winding pads is to provide two parallel take up shafts and to mount on each shaft a series of cores onto which the pad is to be wound. The shafts are then carefully driven at the required speed so that the surface speed of the pads is approximately equal to or slightly greater than the surface speed of the unwind roll from which the web is drawn. Thus, in this way, the pads are supported so that the tapes follow a path which remains directly radial to the original supply roll, that is there is no axial deviation of each tape relative to the next. Therefore, the spacing between each pad and the next pad on each shaft is exactly equal to the width of the intervening tape with that intervening tape being wound on the other one of the shafts. The tape is supplied to the cores for winding by a plurality of lay-on rollers mounted on a common shaft. The shaft carrying the lay-on rollers and the shaft carrying the pads are mounted for relative movement in a direction to accommodate the increasing diameter of the pads.

This process has been used for many years and is believed to provide the best technique for winding of the tapes into the pads. In particular the absence of any axial deviation of the tapes, it is believed, is essential to properly guiding the tapes and avoids any side to side deviation in the tapes so that they can be laid directly onto the surface of the pad.

However despite the application of great care in the managing and control of the tapes in its winding process, there is significant failure in the winding process leading to many situations where rewinding becomes necessary due to the poor quality of the originally wound pad.

This arises particularly in that the thickness of the web necessarily varies across the width of the web. This causes one tape formed from one part of the web to form a pad which is of different diameter from that of another pad. These differences in diameter can lead to difficulty in the simultaneous winding of the tapes by the above process. In particular, as the lay-on rollers are mounted on a common support shaft, those pads which are of larger diameter will be wound too tightly leading to possible crushing of the core. Those pads which are of smaller diameter will have the lay-on roller lose contact with the pad leading to side-to-side wandering of the tape.

It is essential therefore to have an experienced operator watching the winding. In some cases the winding problems will lead to one or two poorly wound pads which then must be rewound after the series of pads is complete. In other cases the operator will identify a situation where the winding is so poor that it cannot be completed on the poorest pads up to the required finished diameter. In such a case it is necessary to stop the winding of all the pads since winding cannot continue with one or more pads missing. In this case all the partially formed pads, which can be 50 to 60, must be rewound.

SUMMARY OF THE INVENTION

It is one object of the present invention, therefore, to provide an improved method and apparatus for winding tape into pads.

According to one aspect of the invention there is provided a method for winding tape comprising:

unwinding a web from a supply roll;

slitting the web into a plurality of side-by-side tapes;

providing for each tape a respective one of a plurality of cylindrical core members onto which the tape is to be wound;

causing rotation of each core member and guiding each tape to the respective core member so as to be wrapped therearound at a fixed axial position relative to the respective core member such that the tape is wrapped around the respective core member with each turn of tape lying directly on top of a previous turn of tape to form a pad of the tape locating each of the core members relative to the next so as to define an axial spacing between each core member and the next;

and guiding the tapes such that each of the tapes is moved relative to the next in a direction transverse to the width of the web so as to increase a spacing between the tapes as each of the tapes moves from the web to the respective core member.

Preferably the method includes:

providing for each tape a respective one of a plurality of lay-on rollers and mounting each lay-on roller with an axis of the lay-on roller parallel to the axis of the respective core member;

mounting each core member and a respective lay-on roller for contact of the lay-on roller with the core and for relative movement therebetween in a direction transverse to the axes to increase a distance between the axes, the movement being independent of movement of other ones of the core members and respective lay-on rollers;

and guiding each tape so as to wrap around a part of a periphery of the respective lay-on roller;

the rotation of the core members being arranged such that the respective lay-on roller rotates therewith.

Preferably the rotation of the core and the lay-on roller is caused by driving the lay-on roller.

Preferably the rotation of the core and the lay-on roller is caused by surface driving the pad.

Preferably each lay-on roller is mounted on a respective arm and wherein the arm is pivotally mounted about an axis at an end of the arm parallel to the axis of the lay-on roller and opposite to the lay-on roller.

Preferably the method includes providing a pinch roller parallel to the lay-on roller having a periphery for contacting a periphery of the lay-on roller.

Preferably the pinch roller is slidable in a direction at right angles to the axis of the pinch roller for movement toward and away from the lay-on roller.

Preferably each arm is adjustable in a direction axially of the lay-on roller so as to increase and decrease spacing between the arms.

Preferably a plurality of arms are mounted on a shaft, the shaft being arranged at the end of the arm opposite the lay-on roller.

Preferably the shaft is drivingly rotatable and wherein there is provided means for connection of rotation of the shaft to the lay-on roller.

Preferably the arm includes a pulley coaxially arranged around the shaft and releasably clamped to the shaft and wherein the drive means includes an elongate continuous drive member wrapped around a pulley and arranged for driving the lay-on roller.

Preferably the arm includes a mounting member at an end of the arm opposite the lay-on roller, the mounting member being engaged over a fixed element adjacent the shaft and the arm being pivotal relative to the mounting member.

Preferably the method includes pressure biasing means extending between the mounting member and the arm for applying a force to the arm for pivoting the arm about the axis of the shaft.

Preferably the core comprises a cylindrical body and a pair of disc adapters at ends of the body, the disc adapters including bearings allowing rotation of the cylindrical body relative to an inner part of the disc, the inner part of the disc adapter being mounted on a shaft carrying a plurality of the core members.

Preferably each tape, with the possible exception of one middle tape, includes a portion along its length which is turned through an angle about an axis longitudinal to the tape and wherein the increase in the spacing between the tapes occurs in the length of said portion.

According to a second aspect of the invention there is provided a method for winding tape comprising:

unwinding a web from a supply roll;

slitting the web into a plurality of side-by-side tapes;

providing for each tape a respective one of a plurality of cylindrical core members onto which the tape is to be wound and mounting each core member for rotation of the core member about an axis of the core member;

providing for each tape a respective one of a plurality of lay-on rollers and mounting each lay-on roller with an axis of the lay-on roller parallel to the axis of the respective core member;

mounting each core member and a respective lay-on roller for contact of the lay-on roller with the core and for relative movement therebetween in a direction transverse to the axes to increase a distance between the axes, the movement being independent of movement of other ones of the core members and respective lay-on rollers;

guiding each tape so as to wrap around a part of a periphery of the respective lay-on roller;

and causing rotation of the respective core and the respective lay-on roller while maintaining the lay-on roller and the tape thereon at a fixed axial position relative to the respective core such that the tape is wrapped around the core with each turn of tape lying directly on top of a previous turn of tape to form a pad of the tape.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
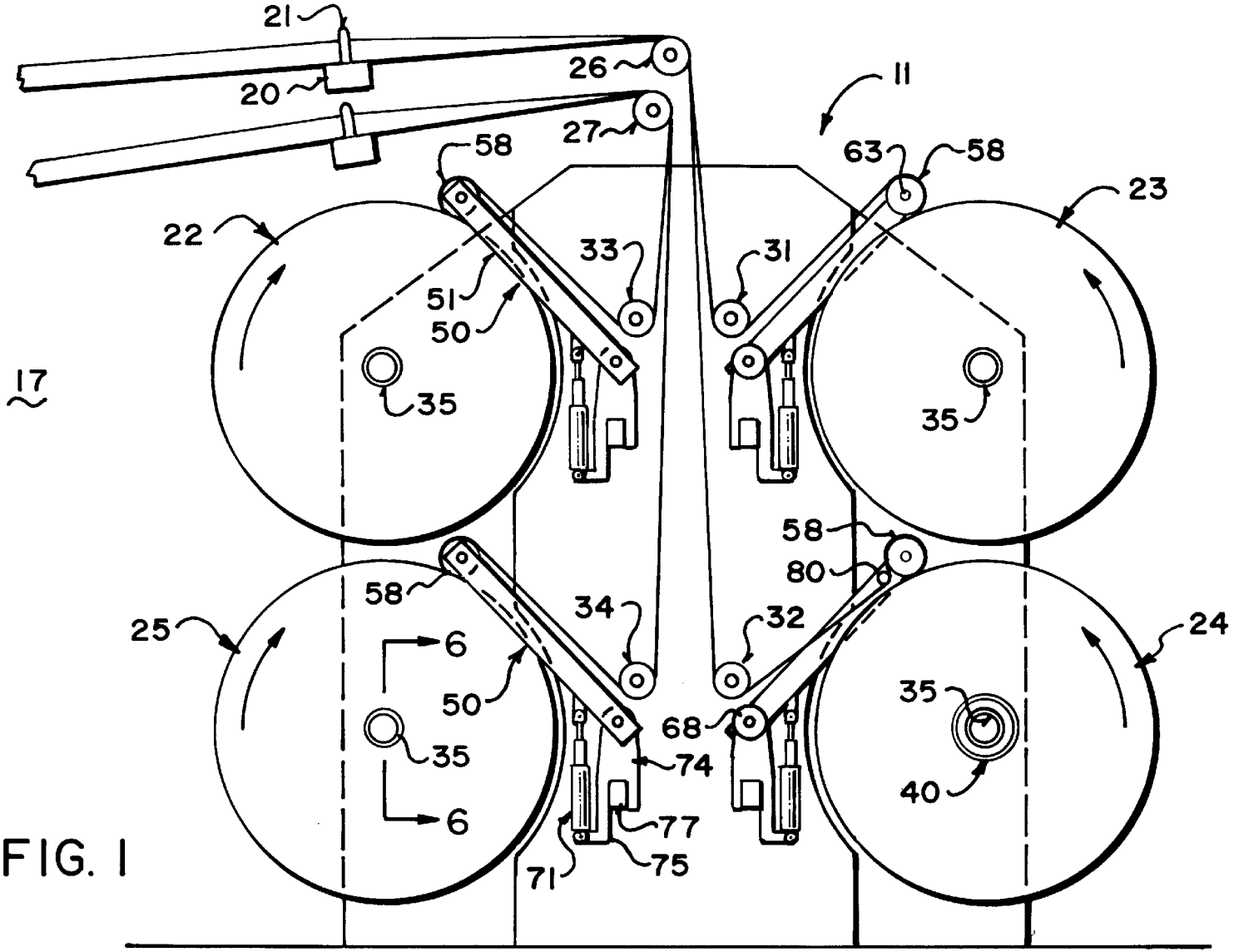
FIG. 1 is an end elevational view of the winding section of a tape winding machine according to the present invention.
Figure 2:
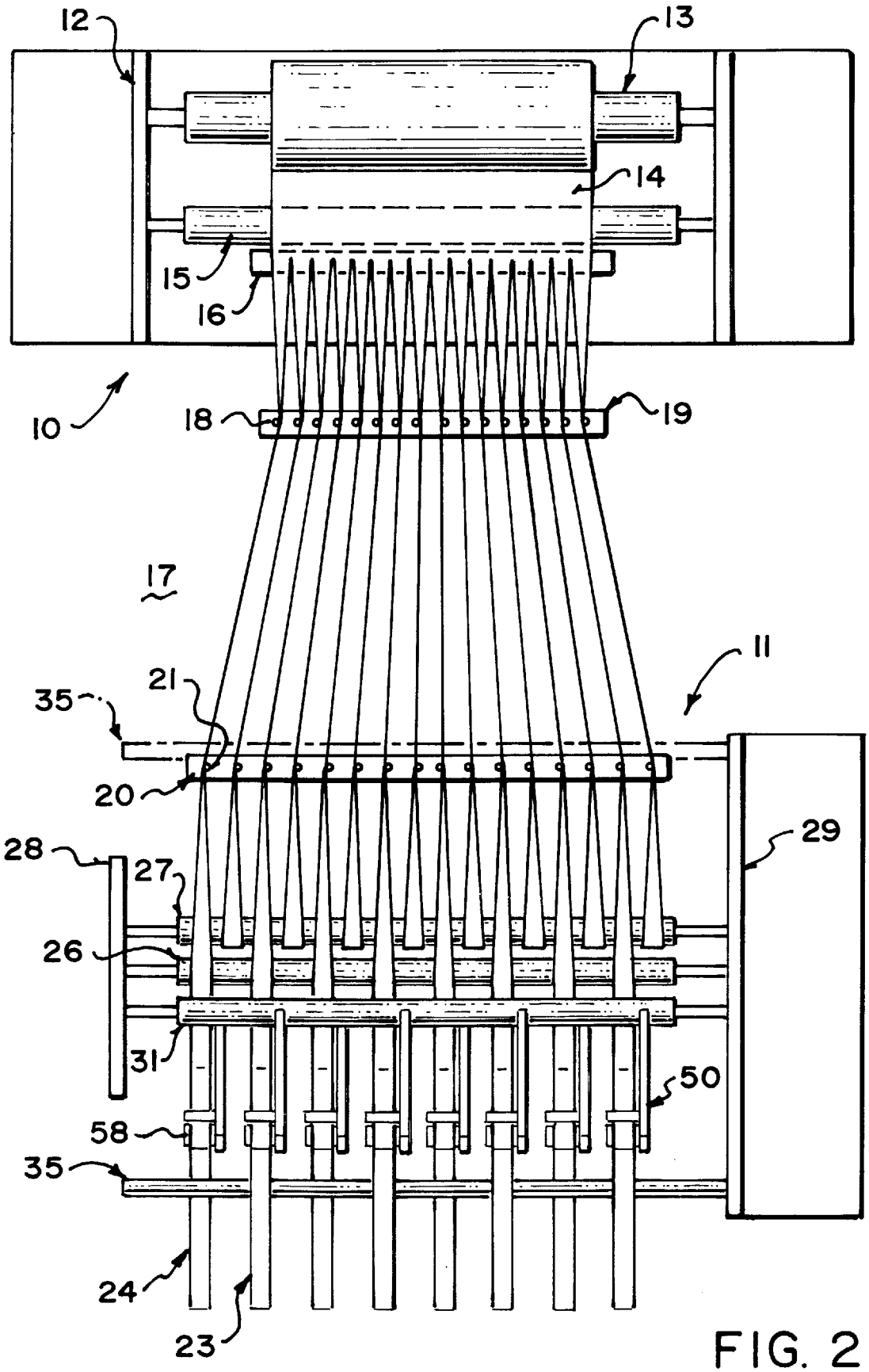
FIG. 2 is a top plan view of the machine of FIG. 1 including the unwind section.

The tape winding machine as shown in the figures comprises an unwind stand generally indicated at 10 and a winding assembly generally indicated at 11. The unwind stand comprises a frame 12 which supports a supply roll 13 of a web of material 14 to be slit into a series of separate tapes. The material 14 can be of any suitable substrate including plastics, foil and other materials which are required for forming the final tape structure.

The frame further supports a guide roller 15 over which the web of material 14 is passed. The rotation of the supply roll and the guide roller is controlled so as to provide a tensioning of the web as it is drawn from the supply roll 14. Downstream of the guide roller 15 is provided a slitter bar 16 carrying a plurality of slitting knives which slit the web into the series of side-by-side tapes. Additional guide rollers may be provided if necessary for properly controlling and guiding the tapes as they move forwardly in the unwind stand subsequent to the slitting.

The tapes are then transferred from the unwind stand 10 to the winding assembly 11 generally passing over an alleyway 17 allowing an operator to access the tapes in their passage from the unwind stand to the winding assembly.

At the unwind side of the alleyway 17 is provided a series of guide pins 18 mounted upon a support bar 19 and on the winding assembly side of the alleyway is provided a similar support bar 20 carrying a plurality of guide pins 21. The guide pins 18 and 21 stand vertically upwardly from the respective support bar so that the tape is turned through 90° from its initial orientation lying in the plane of the web, that is generally horizontal, to a vertical orientation as the tape passes across the alleyway 17. The tape is then turned again through 90° back to the horizontal orientation for entry into the winding system of the winding assembly.

This orientation of the tapes which is vertical across the alleyway allows the spacing between the tapes to be increased as the tapes move across the alleyway. Thus the spacing of the tapes as they exit from the slitting system and guide rollers is exactly equal to the width of the original web. Prior to winding, the tapes are spread outwardly so that each tape is spaced from the next to give sufficient room to provide a more effective winding arrangement for each of the tapes.

At the winding assembly 11, the tapes pass over a series of guide rollers which act to separate the tapes into four different winding stations indicated at 22, 23, 24 and 25. Each winding station has a series of winding elements at axially spaced positions, each for winding a separate one of the tapes. Thus each winding station has one fourth of a total number of winding elements with the total number being equal to the number of tapes.

The guide rollers include a first top pair of guide rollers 26 and 27 each of which extends across the full width of the winding assembly and is mounted for rotation in bearings at end frame members 28 and 29 of the winding assembly. Thus one half of the tapes are directed to the top roller 26 and one half of the tapes are directed to the lower roller 27. Each roller is arranged so that the tapes wrap partly around the roller and then are directed downwardly. The tapes from the roller 26 extend downwardly to one half of the winding assembly for supply to the winding stations 23 and 24. Thus one half of the tapes from the roller 26 pass to a further guide roller 31 feeding the winding station 23 and one half of the tapes from the roller 26 extend further down in the winding assembly to a guide roller 32 feeding the station 24. The station 23 is mounted vertically above the station 24 and the stations 23 and 24 are presented to one side of the winding assembly for access by a service operator. Similarly the tapes from the roller 27 are directed downwardly to an upper guide roller 33 and a lower guide roller 34 directing the tapes to the winding stations 22 and 25 respectively which is symmetrical to the winding stations 23 and 24.

Each of the winding stations comprises a support shaft 35 which extends along the machine in fixed stationary position supported from one end thus providing one open end of the shaft onto which cores for receiving the individual tapes can be mounted. The shaft 35 is hollow and includes an air operated bladder which acts to extend outwardly a plurality of engagement pins 38 at spaced positions along the length of the shaft. Each engagement pin cooperates with a respective one of a plurality of cores 40 each for supporting a respective wound pad of the tape.

Each core comprises a cylindrical support surface 41 and a pair of end discs 42 and 43 each of which includes an annular bearing 44. The pin 38 engages with an inner race of the annular bearing 44 so that the outer race carries the cylindrical support surface 41 and allows rotation of that cylindrical support surface relative to the shaft freely of the shaft and freely relative to others of the cores. Thus each core is free to rotate at its individual speed about the shaft.

Figure 3:
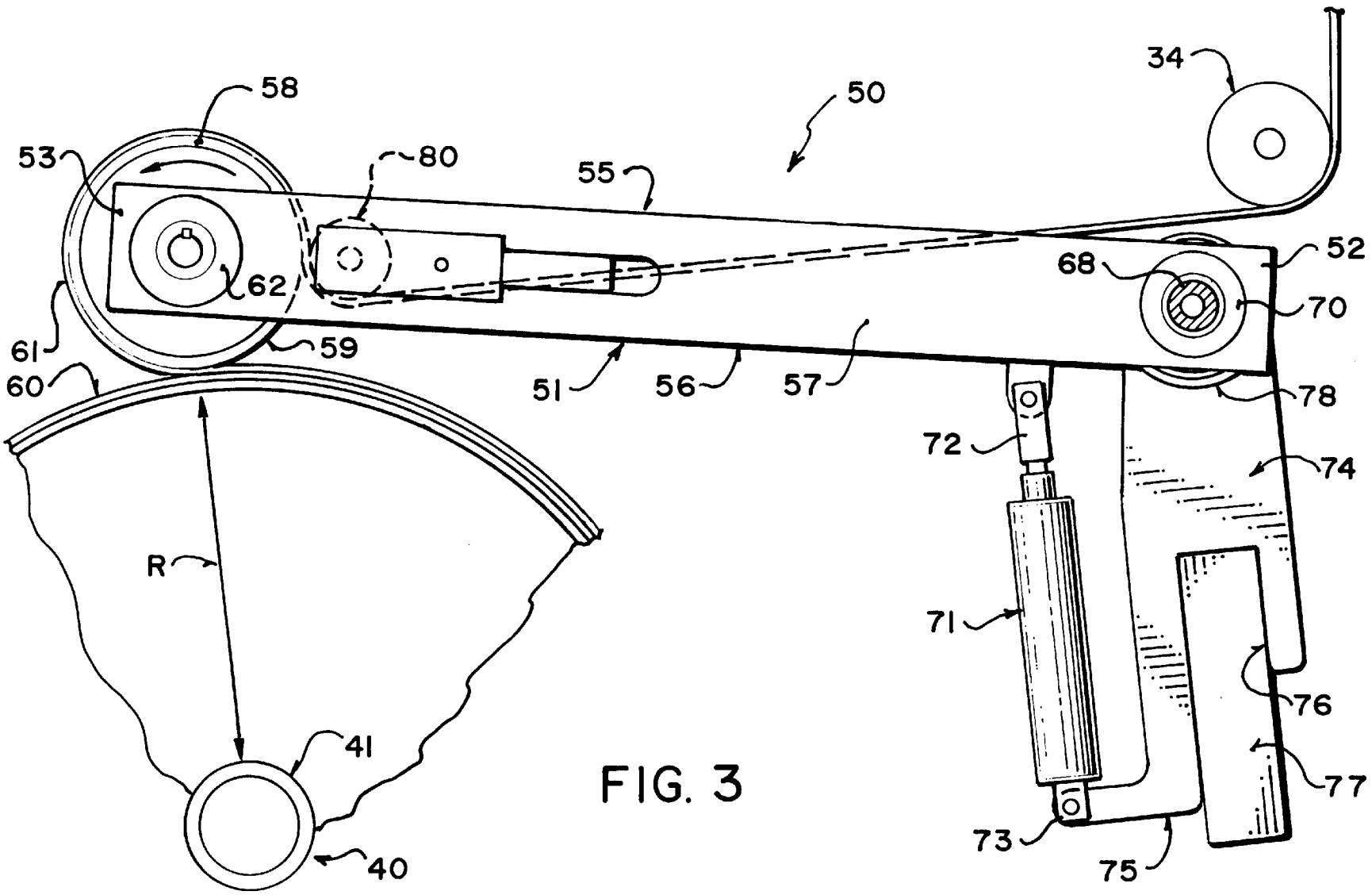
FIG. 3 is an end elevational view on an enlarged scale of one winding arm of a machine of FIG. 1.
Figure 6:
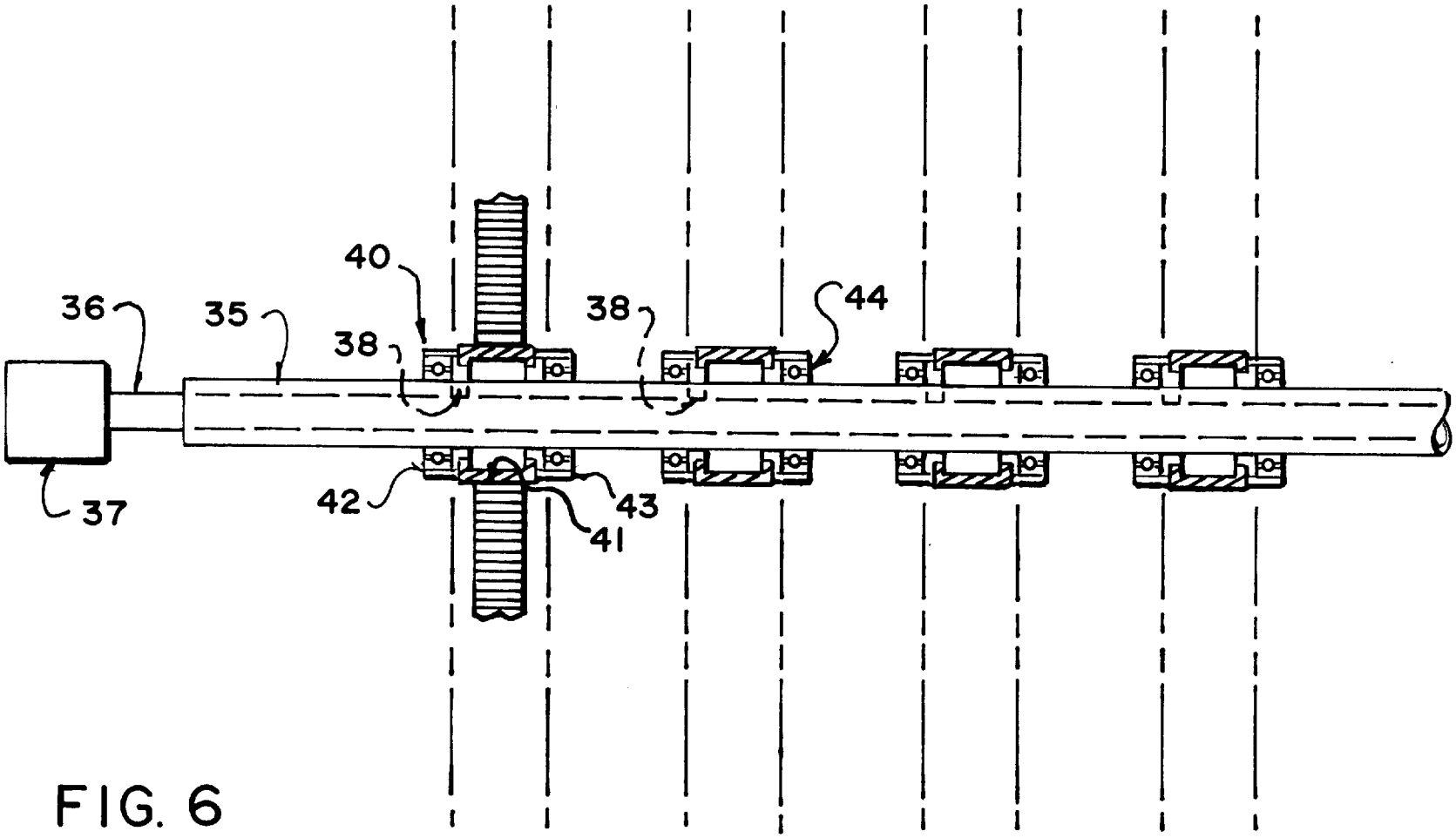
FIG. 6 is a cross sectional view along the lines 6—6 of FIG. 1.

Each individual winding station also includes a respective guide arm 50 for guiding the tape from the guide roller 31, 32, 33 or 34 to the core for winding around the core in a series of spiral turns as shown in FIGS. 1, 3 and 6.

Figure 5:
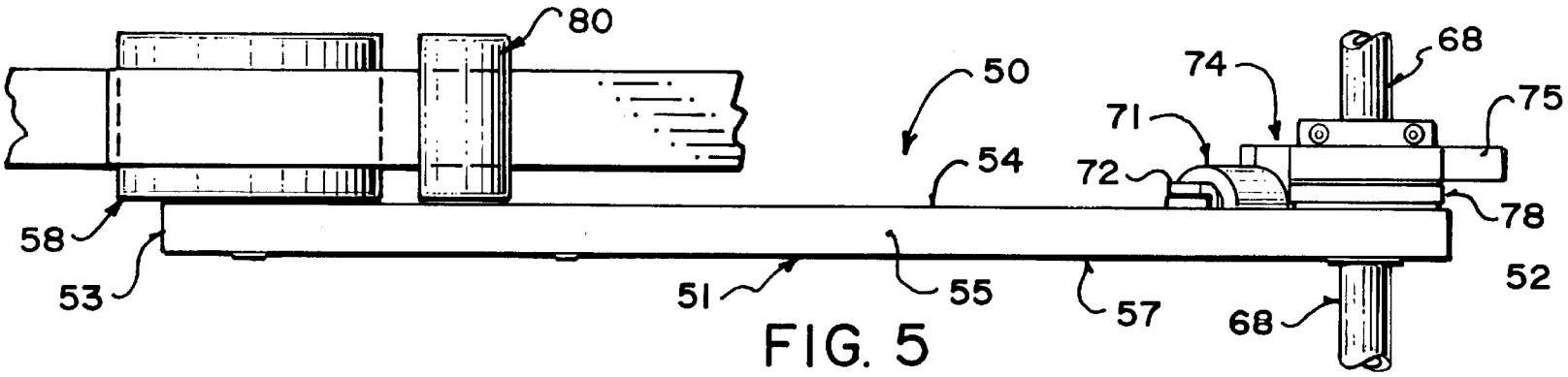
FIG. 5 is a top plan view of the arm of FIG. 3.
Figure 4:
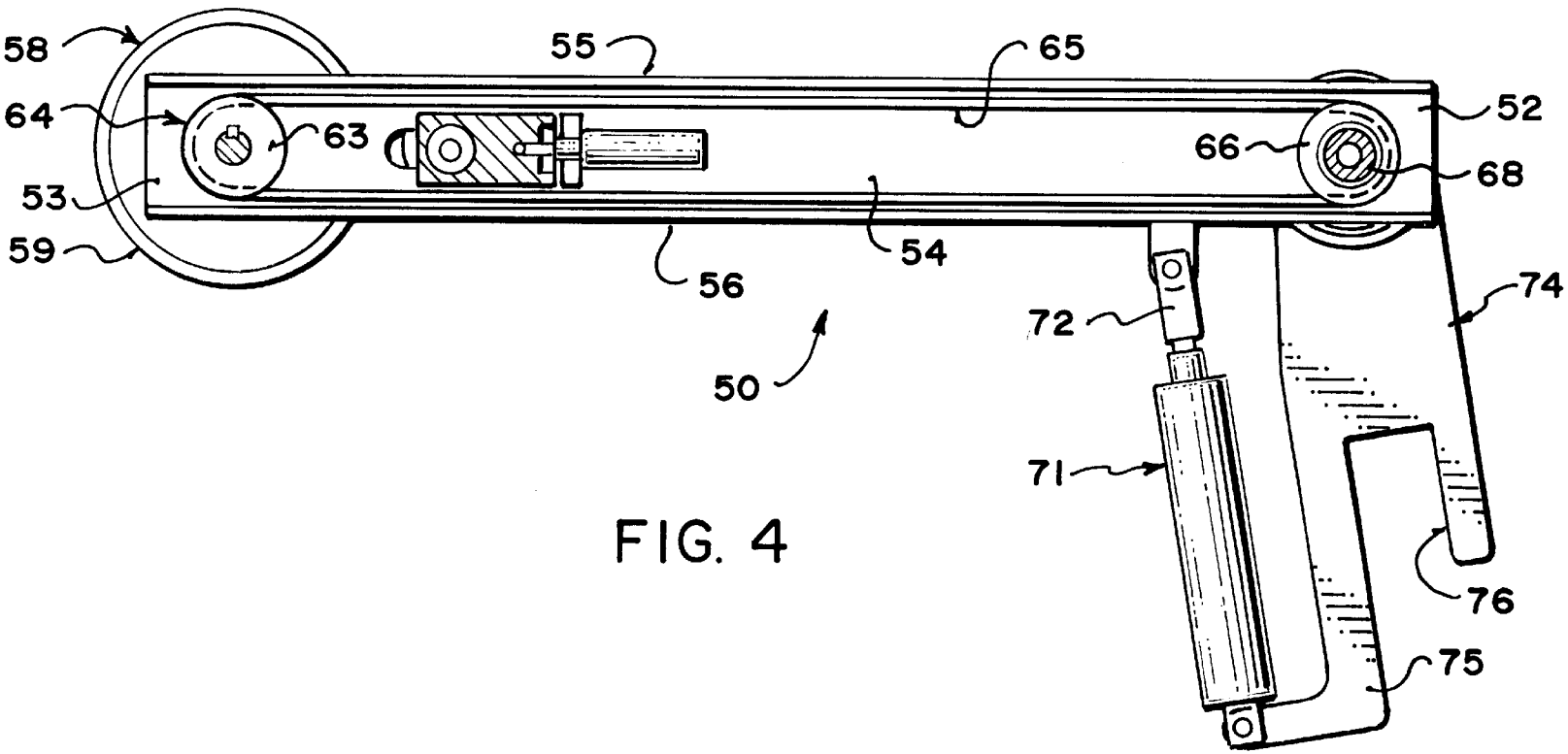
FIG. 4 is a vertical cross sectional view through the arm of FIG. 3.

Each arm 50 is shown in best FIGS. 3, 4 and 5 and comprises an elongate arm 51 having a first end 52 mounted on the winding assembly and an outer or remote end 53 for cooperating with the winding package of tape. The arm is formed from a channel member having a back plate 54, a top plate 55 and a bottom plate 56 and the channel member is closed by a front plate 57.

At the end 53 of the arm is mounted a lay-on roller 58 having a peripheral wall 59 around which the tape passes. The lay-on roller has its peripheral wall sitting on the outside layer 60 of tape wrapped on the cylindrical support surface 41 so that the tape 61 as it passes around the lay-on roller is laid directly onto the outer most layer 60 and thus forms a further layer placed directly on the layer 60 with the side edges of the tape immediately on top of the sides of the package forming the pad.

The lay-on roller is carried in bearings 62 attached to the arm at the end 53 so that the lay-on roller is freely rotatable relative to the arm. The lay-on roller is carried on a shaft 63 carried in the bearing 62 with the shaft also carrying a pulley 64 driven by a belt 65 extending along the arm inside the top and bottom walls. The belt is wrapped around a second pulley 66 at the end 52 of the arm 51. The pulley 66 is clamped onto a shaft 68 extending across the width of the machine so that the shaft 68 cooperates with each of the arms in turn at a particular one of the winding stations. The pulley is split and can be clamped onto the shaft 68 for co-rotation with the shaft or can be released by opening the split to allow the pulley to slide along the shaft to a required position axially of the shaft.

In this way the number of arms on the shaft can be changed and the spacing between the arms and the shaft can be changed to accommodate different widths of tape and different numbers of tapes slit from the web. The position of the arms on the shaft 68 is of course coordinated with the position of the cores 40 on the shaft 35 so that the arms are directly aligned with the cores for wrapping the tape on the cores.

The pulley 66 is carried in a bearing 70 so that the pulley is freely rotatable relative to the arm structure. The arm can thus remain at a predetermined angle relative to the shaft as the shaft and pulley rotate and in addition the arm can rotate about the shaft while the shaft is rotating to accommodate increase in radius R of the wound package.

The arm 51 is spring biased relative to the core and the package thereon by an air cylinder 71 which has one end 72 connected to the arm and a second end 73 connected to a support bracket 74. The support bracket has a lower end 75 which has a slot 76 engaged over a beam 77 of the winding assembly. An upper end 78 of the support bracket 74 is also mounted on the shaft 68 and is rotatable around the shaft so as to allow the shaft to rotate while the bracket 74 remains stationary. The bracket 74 is also pivotal relative to the arm 51 by a bearing 78 so as to allow the gradual pivotal movement of the arm from a lowered position on the core surface 41 to a raised position as the radius of the package R increases.

The arm 51 also carries a pinch roller 80 which can move longitudinally of the arm so that its axis of rotation is maintained parallel to an axis of rotation of the lay-on roller but the axes can be moved closer to a position of pinching as shown in FIG. 3 or spaced positions shown in FIGS. 4 and 5.

As best shown in FIG. 3, the tape guided from the upper roller 27 passes around the guide roller 34 and extends along the arm to wrap partly around the pinch roller 80 whereupon it is laid onto the outside surface of the lay-on roller 58 to wrap around the lay-on roller and thereafter to lay upon the outside surface of the package.

The motive force for driving the tape is provided by the rotation of the shaft 68 so that the shaft 68 drives the lay-on roller on each of the arms. As each of the arms is in effect identical, the angle of velocity of the peripheral surface of the lay-on rollers is constant for all of the arms. The rotation of the package is effected by the driving force communicated from the lay-on roller to the package by the contact of the lay-on roller on the package.

The control over the velocity and location of the tape is thus effected by the lay-on roller so that the tension in the tape is maintained constant from the lay-on roller back to the web for each of the tapes.

At the same time the radius R of the packages can vary so that it is possible that the packages can be at different positions in the build of the package. In this way the machine can accommodate breakdown of a particular tape or restarting of a particular package since the tension and control over the tape is maintained constant by the lay-on rollers regardless of the radius R of the package being built.

Yet further, slight variations in thickness of the tape at different positions across the width of the web can be accommodated by slight variations in the radius R of the package being formed. As stated above, regardless of the radius R, the tension in the tape is maintained constant by the fact that the lay-on rollers are driven at a constant speed independent of the radius R.

The fact that the tapes are spread apart so as to increase the spacing between the tapes provides sufficient space for the arms and the winding arrangement. This spreading of the tapes is normally unacceptable in winding of pads since it would tend to vary the tension in the tapes. However in this arrangement the fact that the tension is controlled by the lay-on rollers ensures that the tapes can be directed as required to the different locations at different axial and angular positions relative to the guide rollers without variations in tape tension.

The tape is guided to a required position axially along the lay-on roller by a plastic guide member (not shown) in the form of a pair of axially spaced guide disks, each on a respective side of the tape, and a pin on which the disks are mounted and over which the tape runs.

Figure 7:
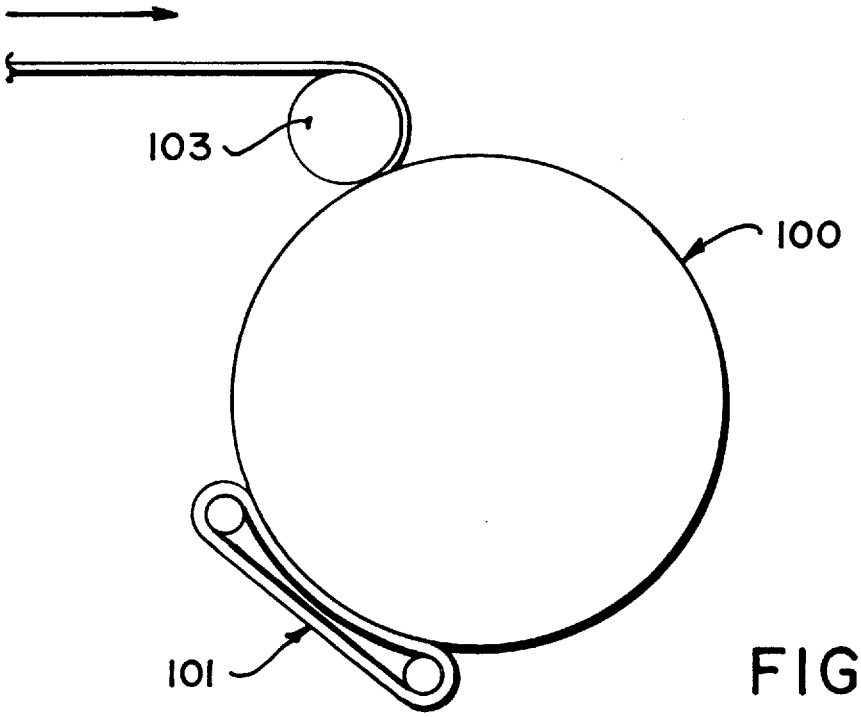
FIGS. 7 and 8 are schematic side elevational views of two alternative winding arrangements.
Figure 8:
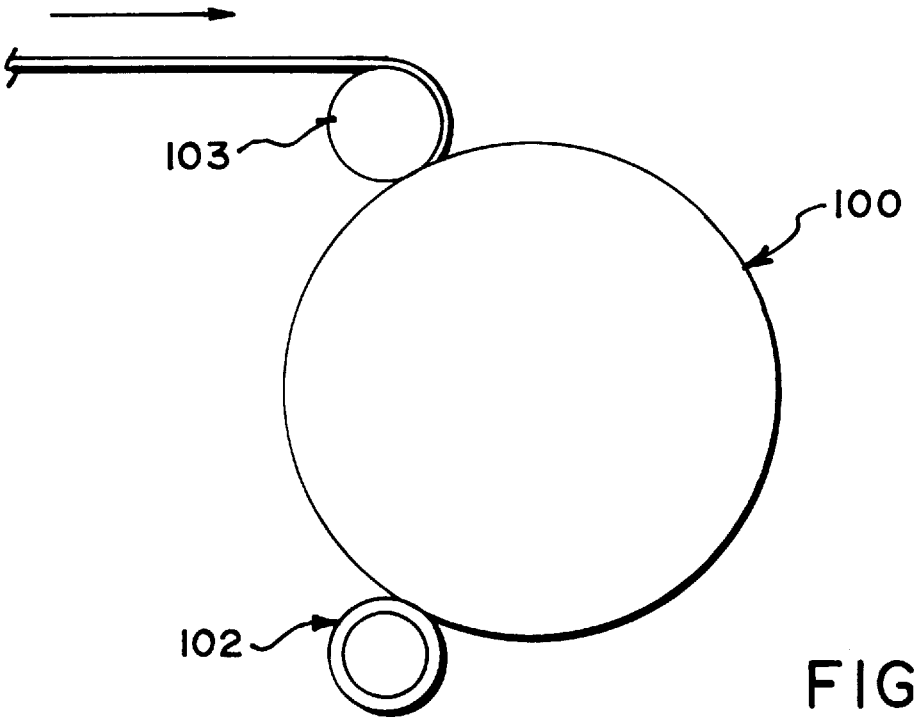

In FIGS. 7 and 8 are shown alternative winding arrangements in which the pad 100 is surface driven and the lay-on roller 103 is mounted for free rotation so that it is driven by the tape passing over the roller onto the package. In FIG. 7 the pad 100 rests on an upper run of a belt 101. In FIG. 8, the pad 100 rests on the surface of a drive roller 102.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

We claim:

1. A method for winding tape comprising:

unwinding a web from a supply roll;

slitting the web into a plurality of side-by-side tapes;

providing for each tape a respective one of a plurality of cylindrical core members onto which the tape is to be wound and mounting each core member for rotation of the core member about an axis of the core member;

providing for each tape a respective one of a plurality of lay-on rollers and mounting each lay-on roller with an axis of the lay-on roller parallel to the axis of the respective core member;

mounting each core member and a respective lay-on roller for contact of the lay-on roller with the core and for relative movement therebetween in a direction transverse to the axes to increase a distance between the axes, the movement being independent of movement of other ones of the core members and respective lay-on rollers;

guiding each tape so as to wrap around a part of a periphery of the respective lay-on roller;

and causing rotation of the respective core and the respective lay-on roller while maintaining the lay-on roller and the tape thereon at a fixed axial position relative to the respective core such that the tape is wrapped around the core with each turn of tape lying directly on top of a previous turn of tape to form a pad of the tape.

2. A method for winding tape comprising:

unwinding a web from a supply roll;

slitting the web at a slitting station into a plurality of side-by-side tapes;

providing for each tape a respective one of a plurality of cylindrical core members onto which the tape is to be wound;

causing rotation of each core member and guiding each tape to the respective core member so as to be wrapped therearound at a fixed axial position relative to the respective core member such that the tape is wrapped around the respective core member with each turn of tape lying directly on top of a previous turn of tape to form a pad of the tape;

locating each of the core members relative to the next at a winding station so as to define an axial spacing between each core member and the next;

guiding the tapes such that each of the tapes is moved relative to the next as the tapes move from the slitting station to the winding station in a direction transverse to the width of the tapes so as to increase a spacing between the tapes as each of the tapes moves from the slitting station to the winding station such that a spacing between two adjacent tapes at the winding station is greater than that between the same two tapes at the slitting station;

providing for each tape a respective one of a plurality of lay-on rollers and mounting each lay-on roller with an axis of the lay-on roller parallel to the axis of the respective core member;

mounting each core member and a respective lay-on roller for contact of the lay-on roller with the core and for relative movement therebetween in a direction transverse to the axes to increase a distance between the axes, the movement being independent of movement of other ones of the core members and respective lay-on rollers;

and guiding each tape so as to wrap around a part of a periphery of the respective lay-on roller;

the rotation of the core members being arranged such that the respective lay-on roller rotates therewith.

3. The method according to claim 2 wherein the rotation of the core and the lay-on roller is caused by driving the lay-on roller.

4. The method according to claim 2 wherein the rotation of the core and the lay-on roller is caused by surface driving the pad.

5. The method according to claim 2 wherein each lay-on roller is mounted on a respective arm and wherein the arm is pivotally mounted about an axis at an end of the arm parallel to the axis of the lay-on roller and opposite to the lay-on roller.

6. The method according to claim 5 wherein each arm is adjustable in a direction axially of the lay-on roller so as to increase and decrease spacing between the arms.

7. The method according to claim 6 wherein a plurality of arms are mounted on a shaft, the shaft being arranged at the end of the arm opposite the lay-on roller.

8. The method according to claim 7 wherein the shaft is drivingly rotatable and wherein there is provided means for connection of rotation of the shaft to the lay-on roller.

9. The method according to claim 8 wherein the arm includes a pulley coaxially arranged around the shaft and releasably clamped to the shaft and wherein the drive means includes an elongate continuous drive member wrapped around a pulley and arranged for driving the lay-on roller.

10. The method according to claim 8 wherein the arm includes a mounting member at an end of the arm opposite the lay-on roller, the mounting member being engaged over a fixed element adjacent the shaft and the arm being pivotal relative to the mounting member.

11. The method according to claim 10 including pressure biasing means extending between the mounting member and the arm for applying a force to the arm for pivoting the arm about the axis of the shaft.

12. The method according to claim 2 wherein the core comprises a cylindrical body and a pair of disc adapters at ends of the body, the disc adapters including bearings allowing rotation of the cylindrical body relative to an inner part of the disc adapters, the inner part of the disc adapters being mounted on a shaft carrying a plurality of the core members.

13. The method according to claim 2 including providing a pinch roller parallel to the lay-on roller having a periphery for contacting a periphery of the lay-on roller.

14. The method according to claim 13 wherein the pinch roller is slidable in a direction at right angles to the axis of the pinch roller for movement toward and away from the lay-on roller.

15. An apparatus for winding tape comprising:

a web supply roll;

a slitting station having plurality of slitting knives for slitting the web into a plurality of side-by-side tapes;

a winding station having plurality of cylindrical core members onto which the tape is to be wound;

drive means causing rotation of each core member;

guide means guiding each tape to the respective core member so as to be wrapped therearound at a fixed axial position relative to the respective core member such that the tape is wrapped around the respective core member with each turn of tape lying directly on top of a previous turn of tape to form a pad of the tape;

and mounting means locating each of the core members relative to the next so as to define an axial spacing between each core member and the next;

said guide means being arranged such that each of the tapes is moved relative to the next as the tapes move from the slitting station to the winding station in a direction transverse to the width of the tapes so as to increase a spacing between the tapes as each of the tapes moves from the slitting station to winding station such that a spacing between two adjacent tapes at the winding station is greater than that between the same two tapes at the slitting station;

including for each tape a respective one of a plurality of lay-on rollers with an axis of the lay-on roller parallel to the axis of the respective core member, each core member and a respective lay-on roller being mounted for contact of the lay-on roller with the core and for relative movement therebetween in a direction transverse to the axes to increase a distance between the axes, the movement being independent of movement of other ones of the core members and respective lay-on rollers; and means for guiding each tape so as to wrap around a part of a periphery of the respective lay-on roller; the rotation of the core members being arranged such that the respective lay-on roller rotates therewith.

16. The apparatus according to claim 15 wherein each lay-on roller is mounted on a respective arm and wherein the arm is pivotally mounted about an axis at an end of the arm parallel to the axis of the lay-on roller and opposite to the lay-on roller.

17. The apparatus according to claim 16 wherein each arm is adjustable in a direction axially of the lay-on roller so as to increase and decrease spacing between the arms.

18. The apparatus according to claim 17 wherein a plurality of arms are mounted on a shaft, the shaft being arranged at the end of the arm opposite the lay-on roller.

19. The apparatus according to claim 18 wherein the shaft is drivingly rotatable and wherein there is provided means for connection of rotation of the shaft to the lay-on roller.

20. The apparatus according to claim 19 wherein the arm includes a pulley coaxially arranged around the shaft and releasably clamped to the shaft and wherein the drive means includes an elongate continuous drive member wrapped around a pulley and arranged for driving the lay-on roller.

21. The apparatus according to claim 19 wherein the arm includes a mounting member at an end of the arm opposite the lay-on roller, the mounting member being engaged over a fixed element adjacent the shaft and the arm being pivotal relative to the mounting member.

22. The apparatus according to claim 21 including pressure biasing means extending between the mounting member and the arm for applying a force to the arm for pivoting the arm about the axis of the shaft.

23. The apparatus according to claim 15 including a pinch roller parallel to the lay-on roller having a periphery for contacting a periphery of the lay-on roller.

24. The apparatus according to claim 23 wherein the pinch roller is slidable in a direction at right angles to the axis of the pinch roller for movement toward and away from the lay-on roller.

25. The method according to claim 15 wherein the core comprises a cylindrical body and a pair of disc adapters at ends of the body, the disc adapters including bearings allowing rotation of the cylindrical body relative to an inner part of the disc adapters, the inner part of the disc adapters being mounted on a shaft carrying a plurality of the core members.

* * * * *